US005131479A

United States Patent [19]

Boulet et al.

[11] Patent Number: 5,131,479

[45] Date of Patent: Jul. 21, 1992

[54] ROTARY DRILLING DEVICE COMPRISING MEANS FOR ADJUSTING THE AZIMUTH ANGLE OF THE PATH OF THE DRILLING TOOL AND CORRESPONDING DRILLING PROCESS

[75] Inventors: Jean Boulet, Paris; Pierre Morin, Levallois Perret, both of France

[73] Assignee: Institut Francais du Petrole, Rueil Malmaison, France

[21] Appl. No.: 662,251

[22] Filed: Feb. 28, 1991

[30] Foreign Application Priority Data

Mar. 7, 1990 [FR] France ..... 90 02876

[51] Int. Cl.[5] ..... E21B 7/08

[52] U.S. Cl. ..... 175/73; 175/76; 175/325.3

[58] Field of Search ..... 175/61. 73, 74, 76, 175/320, 325; 73/151

[56] References Cited

U.S. PATENT DOCUMENTS

| | | | |
|---|---|---|---|
| Re. 29,526 | 1/1978 | Jeter | 175/61 X |
| 2,819,040 | 1/1958 | James et al. . | |
| 3,156,310 | 11/1964 | Frisby | 175/76 |
| 4,076,084 | 2/1978 | Tighe | 175/73 |
| 4,476,943 | 10/1984 | Williams | 175/61 |
| 4,804,051 | 2/1989 | Ho | 175/45 X |
| 4,813,274 | 3/1989 | DiPersio et al. | 73/151 |

FOREIGN PATENT DOCUMENTS

| | | |
|---|---|---|
| 0377378 | 12/1989 | European Pat. Off. . |
| 1486421 | 5/1966 | France . |
| 2622920 | 11/1987 | France . |

*Primary Examiner*—Terry Lee Melius

*Attorney, Agent, or Firm*—Fay, Sharpe, Beall, Fagan, Minnich & McKee

[57] ABSTRACT

The device comprises a set of rods having a first end, by means of which the rotation is transmitted to the set of rods and the axial force to the tool (3) during drilling, and a second end to which the tool (3) is fastened. The device comprises means for adjusting the azimuth angle of the path of the drilling tool which consists of a tubular body (10) comprising a radially projecting bearing blade (11) and mounted rotatably on the set of rods (2), and a remotely actuable junction means making it possible to fix the set of rods (2) and the tubular body (10) relative to one another in terms of rotation in its active position. In the inactive position of the junction means, the set of rods (2) is freely rotatable within the tubular body which is held immobile in terms of rotation in the drill hole by means of the bearing blade (11). The bearing blade (11) is placed in the drill hole in an angular orientation making it possible to adjust the azimuth angle in the desired direction.

16 Claims, 8 Drawing Sheets

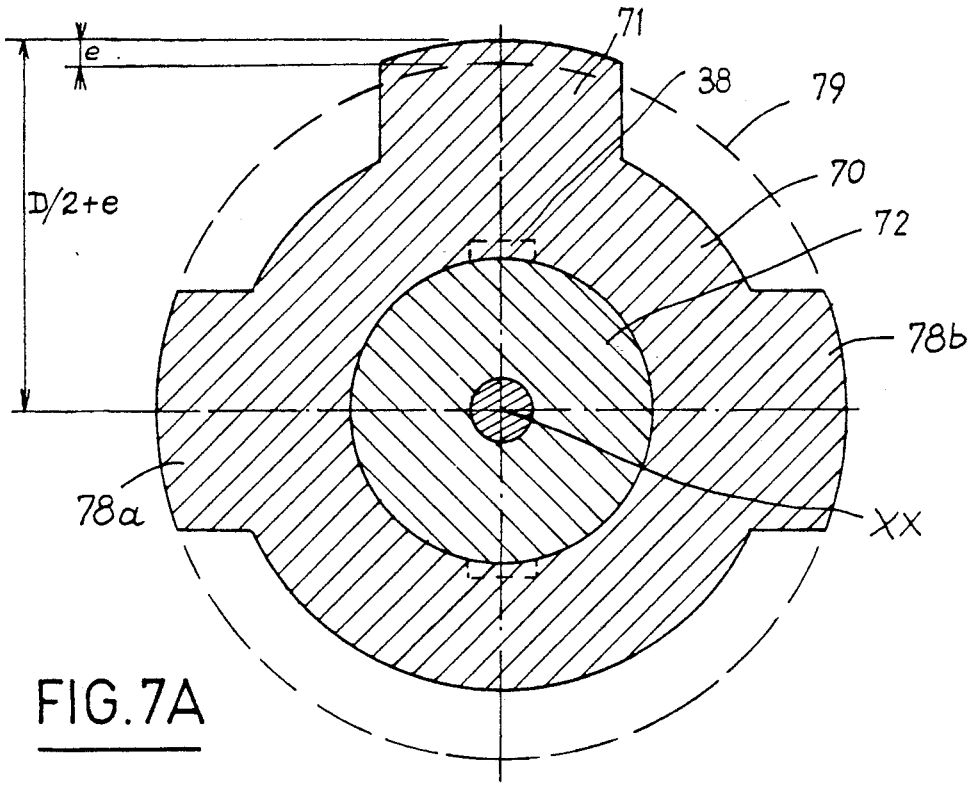
FIG.7A
FIG.7B
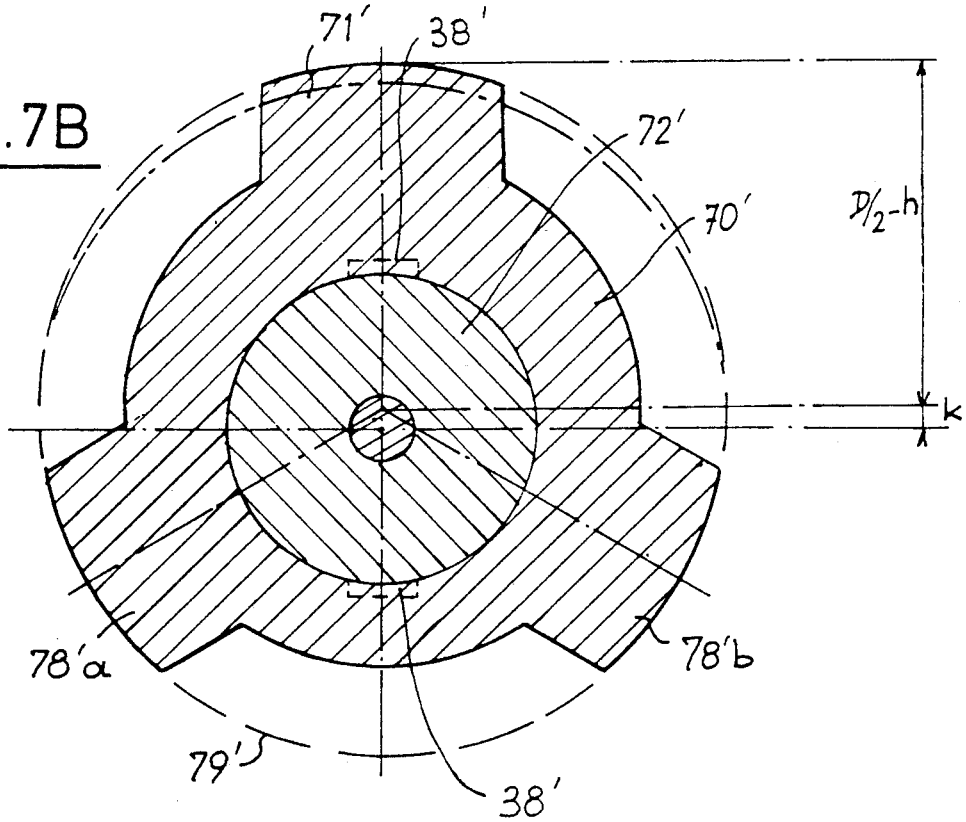

ROTARY DRILLING DEVICE COMPRISING MEANS FOR ADJUSTING THE AZIMUTH ANGLE OF THE PATH OF THE DRILLING TOOL AND CORRESPONDING DRILLING PROCESS

The invention relates to a rotary drilling device comprising means for adjusting the azimuth angle of the path of the drilling tool, these means being remotely controllable.

In current drilling, especially petroleum drilling techniques, there are known processes and devices making it possible to carry out some remote adjustment of the path of the drilling tool.

This adjustment can be relative to the inclination of the path, that is to say to the angle of this path to the vertical, and this angle can be modified by remote control during drilling. This adjustment can also relate to the azimuth angle of the path, that is to say to the direction of this path in relation to the direction of the magnetic north.

The drilling tool can be driven in rotation by means of a set of rods, of which one end located at the surface is connected to a means for driving in rotation. Where this process known as rotary drilling is concerned, the axial force on the tool is likewise exerted by means of a set of rods.

In addition to rotary drilling, there are other known drilling processes employing a bottom motor or turbine connected to the end of a set of rods and having a drive shaft fixed to the tool.

Both as regards rotary drilling and with respect to drilling with a bottom motor, the rods of the set of rods are produced in tubular form and allow a drilling fluid to circulate in the axial direction of the set of rods between the surface and the drilling tool.

When a bottom motor is used, this can be driven by the pressurised drilling fluid conveyed in the set of rods.

Hitherto, it has been possible to carry out the adjustment of the azimuth angle of the path of the drilling tool only in the case of drilling with a bottom motor. As regards rotary drilling, there has been no known remote-controlled device making it possible, as a function of data obtained by telemetering, to adjust the azimuth angle of the direction of drilling when a path correction proves necessary.

The object of the invention is, therefore, to provide a rotary drilling device comprising remote-controlled means for adjusting the azimuth angle of the path of the drilling tool and a set of rods having a first end connected to means for setting the set of rods in rotation about its axis and for exerting an axially directed force on the set of rods and to means for supplying drilling fluid to the set of rods, ensuring an axial circulation of the drilling fluid as far as the drilling tool fastened to the second end of the set of rods, this device being capable, during the advance, of functioning, as required, either with an adjustment of the azimuth angle of the drilling path or without a monitoring of the azimuth angle of this path.

To achieve this, the means for adjusting the azimuth angle of the path of the drilling tool consist of, a tubular body comprising at least one radially outwardly-projecting bearing blade, mounted rotatably on the set of rods about its axis coinciding with the axis of the set of rods and fixed in terms of translational movement to the set of rods, and a junction means between the set of rods and the tubular body, carried by the set of rods, movable between an active position and an inactive position and remotely actuable by control means activated by the drilling fluid circulating in the set of rods, making it possible, in its active position, to drive the tubular body in rotation by means of the set of rods and, in its inactive position, to rotate the set of rods within the tubular body, the adjustment of the azimuth angle of the path of the drilling tool thus being ensured by the bringing of the blade of the tubular body to bear on the wall of the drill hole in a specific position and as a result of the mutual angular misalignment of two parts of the set of rods which are located respectively between the first end of the set of rods and the tubular body and between the tubular body and the second end of the set of rods.

To make it easy to understand the invention, an embodiment of a drilling device according to the invention will now be described by way of non-limiting example with reference to the accompanying Figures.

FIG. 2A is a view in axial section of the upper part of the adjustment means connected to that part of the set of rods comprising the first end of this set of rods located at the surface.

FIG. 2B is a view in axial section of the lower part of the adjustment means connected to the drilling tool.

FIG. 7A is a cross-sectional view according to A—A of FIG. 7, showing a first alternative embodiment of the tubular body of the adjustment means.

FIG. 7B is a view similar to that of FIG. 7A, showing a second alternative embodiment of the tubular body of the ad means illustrated in FIG. 7.

Figure 1:
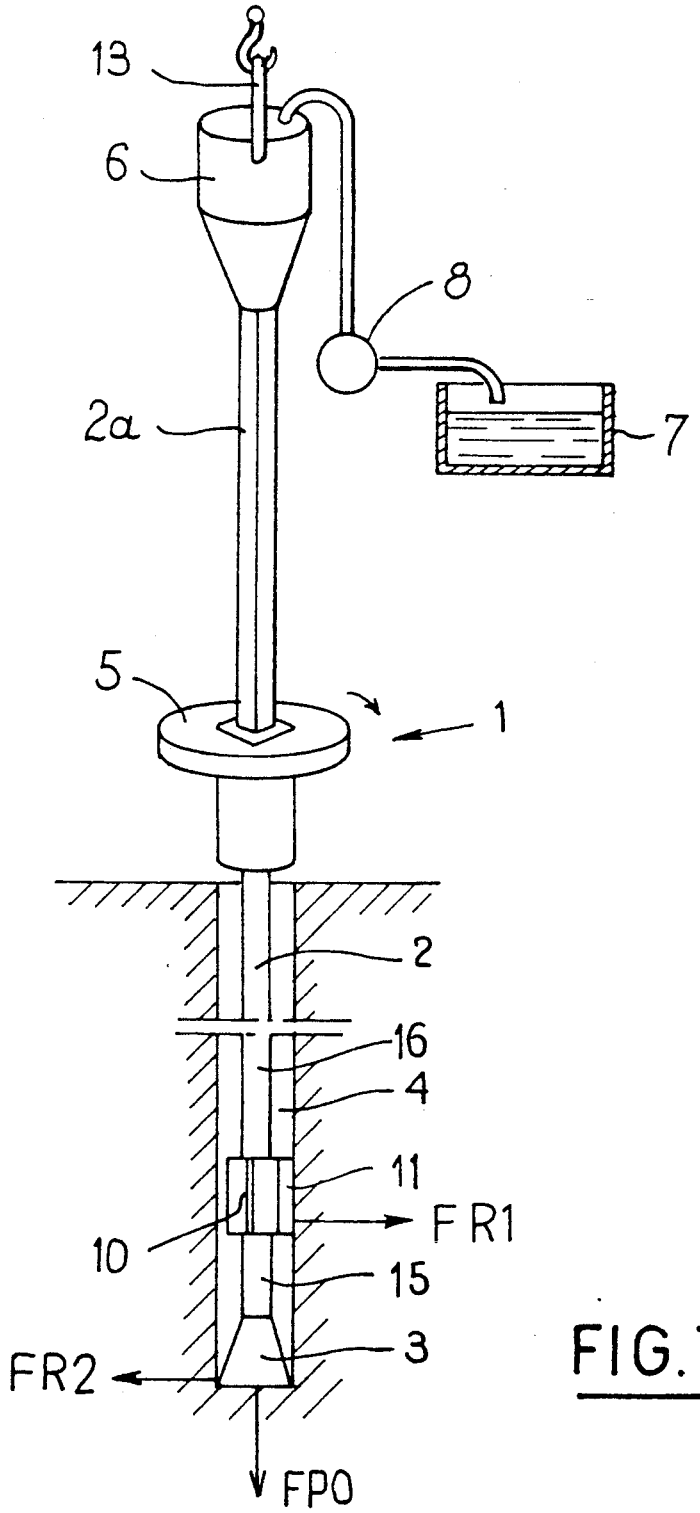
FIG. 1 is a diagrammatic view of a rotary drilling device.

FIG. 1 shows a rotary drilling device 1, the set of rods 2 of which carries at its end the drilling tool 3 advancing in order to make the drill hole 4.

The end of the set of rods located opposite the tool 3 is connected to a device 5 for driving the set of rods 2 in rotation about its axis.

The rod 2*a* located in the upper part of the set of rods 2 is of square cross-section, and the means 5 for driving the set of rods in rotation consists of a horizontal turntable through which passes an orifice making it possible to engage the rod of square cross-section. Setting the table in rotation by means of a motor assembly makes it possible to drive the rod of square cross-section 2*a* and the set of rods 2 in rotation, whilst at the same time allowing the axial displacement of the set of rods, in order to carry out the drilling.

A weight is applied to the upper end of the set of rods, in order to exert an axially directed force on the set of rods and on the tool, allowing it to be laid with sufficient pressure onto the bottom of the drill hole 4.

Furthermore, the upper end of the set of rods forming its first end opposite the second end connected to the drilling tool 3 comprises a drilling-fluid injection head 6 connected to the first rod 2*a*, so as to inject the pressurised drilling fluid into its inner bore. The drilling fluid circulates in the axial direction within the set of rods and over its entire length, so as to reach as far as the lower part of the drilling device in the region of the tool 3. The drilling fluid performs the scavenging of the bottom of the drill hole 4 and then rises towards the surface again in the annular space located between the set of rods and the wall of the drill hole 4, thereby carrying along with it rock debris torn away by the drilling tool 3.

The drilling fluid laden with debris is recovered at the surface, separated from the debris and recycled in a tank 7. A pump 8 makes it possible to return the drilling fluid into the injection head 6.

The drilling device 1 comprises, in its lower part, means for adjusting the azimuth angle which comprise a tubular body 10 having a bearing blade 11 projecting radially relative to the actual tubular body.

The set of rods 2 is mounted rotatably about its axis within the tubular body 10, the axis of which coincides with the axis of the set of rods.

Moreover, in its upper part, the rotary drilling device is suspended on a lifting device by means of a hook 13, making it possible to release the weight exerting a thrust on the set of rods 2 and on the tool 3 and to raise the set of rods and the tool.

The drilling device has a means for connecting the set of drill rods 2 and the tubular body 10 in terms of rotation; this device can be actuated in order to be placed in an active position or an inactive position.

When the connection device is in its active position, the tubular body 10 is driven in rotation together with the set of rods. In this case, the set of drill rods 2, the tubular body 10 and the tool 3 are set in rotation as a whole about the axis of the set of rods. The drilling device then functions without an adjustment of the azimuth angle of the drilling path, drilling being carried out in the axial direction of the set of rods.

When the device for connecting the set of drill rods 2 and the tubular body 10 is in the inactive position, the set of rods 2 can be set in rotation within the tubular body 10. The application of an axial force FPo to the tool by means of the set of rods generates a lateral reaction force $FR_2$ exerted on the wall of the drill hole 4. The force $FR_2$ is absorbed by the bearing blade 11 of the tubular body 10 (force $FR_1$). Under the effect of the force $FR_1$, the bearing blade 11 is held immobile in terms of rotation against the wall of the drill hole 4.

The azimuth direction of the drilling path is thus determined by the angular position of the bearing blade 11 in the drill hole about the axis of the set of rods and by the angle of misalignment of the lower section 15 of the set of rods fixed to the tool 3 in relation to the upper section 16 comprising the first end of the set of rods located at the surface.

The choice of the position of the blade 11 and the characteristics of the tubular body 10 and/or of the set of rods make it possible to adjust the azimuth angle to the desired value.

A first embodiment of the means according to the invention making it possible to carry out an adjustment of the azimuth angle of the direction of the drilling path of the device illustrated in FIG. 1 will now be described with reference to FIGS. 2A and 2B.

Figure 2A:
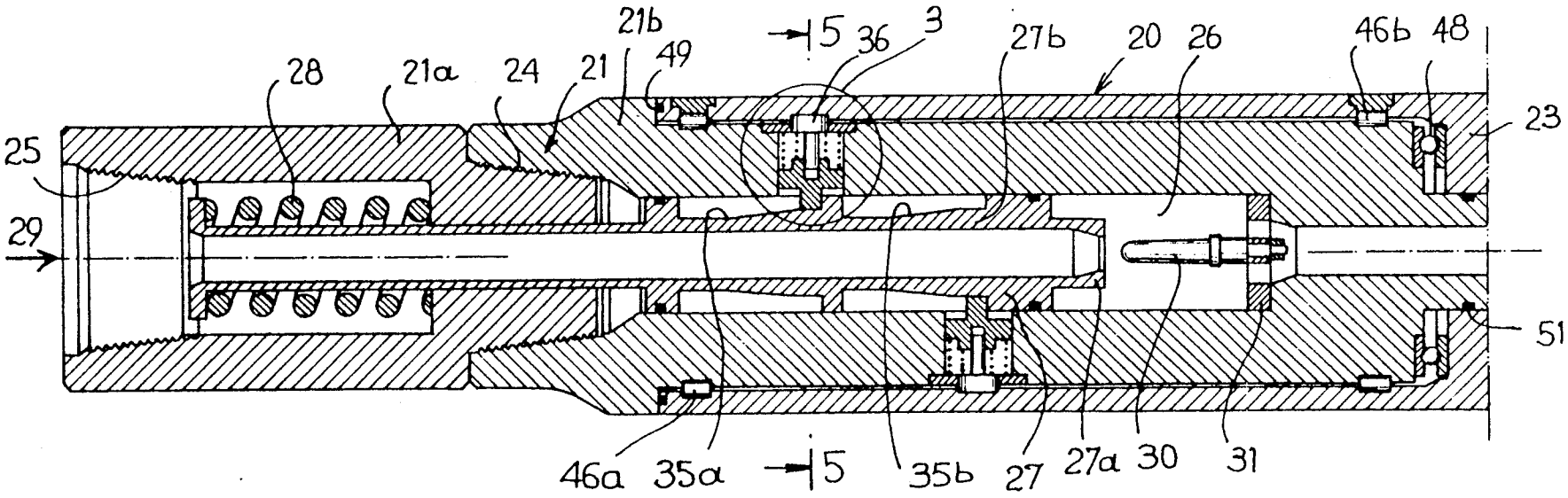
FIGS. 2A and 2B are views in axial section of means for adjusting the azimuth angle of the path of a rotary drilling, tool according to a first embodiment.
Figure 2B:
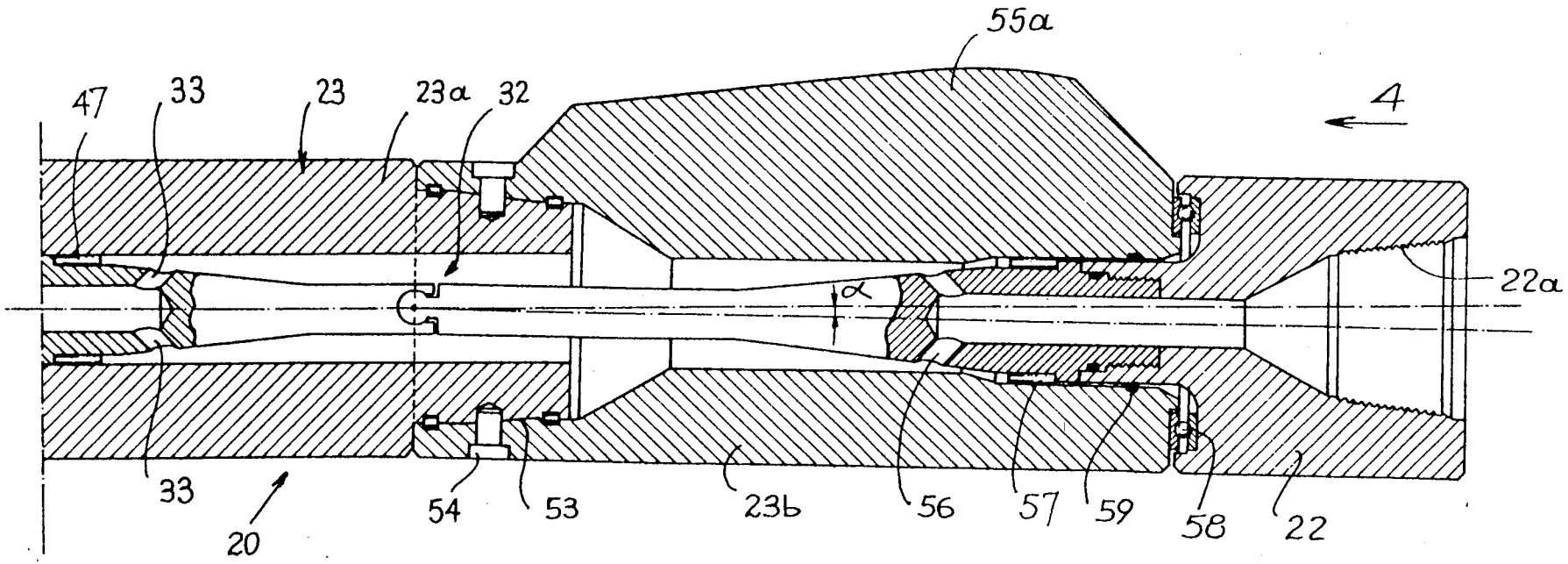

FIGS. 2A and 2B show as a whole 20 the means for adjusting the azimuth angle of the direction of the path of a drilling device according to the invention.

The device 20 mainly consists of a first element 21 of the set of drill rods, of a second element 22 of the set of rods connected in an articulated manner to the end of the first element and of a tubular body 23 in two parts 23*a* and 23*b* defining two successive sections, the axes of which are at an adjustable angle $\alpha$, the first element 21 of the set of rods being mounted rotatably in the first section of the tubular body, and the second element 22 of the set of rods being mounted rotatably in the second section of the tubular body 23.

The first element 21 of the set of rods consists of two successive parts 21*a* and 21*b* connected to one another as a result of the screwing of the externally threaded frustoconical end 24 of the first part 21*a* into an internally threaded bore of corresponding shape of the second part 21*b*.

The first part 21*a* of the first element 21 has an internally threaded frustoconical bore 25 intended for making the rigid connection of the first element 21 of the set of rods to the upper section comprising the first end of the set of rods terminating at the surface and interacting with the means for driving the set of drill rods in rotation.

The element 21 is produced in tubular form and possesses in its part 21*b* a bore 26 of widened diameter, in which is mounted the assembly as a whole of the means for controlling the connection device between the set of rods and the tubular body 23. This assembly comprises a piston 27 mounted movably in terms of translational motion and rotation within the bore 26 and returned towards the first end of the set of rods by a helical spring 28 mounted inside the first part 21*a* of the element 21 of the set of rods.

The piston 27 is produced in tubular form and delimits the central conduit communicating at its two ends with the bore of the set of rods, through which passes, during drilling, a flow Q of drilling fluid circulating axially and in the direction indicated by the arrow 29.

The end of the central conduit of the piston 27 located downstream in terms of the circulation of the drilling fluid is profiled so as to form a contracted part 27*a* confronting and in proximity to the end part of frustoconical shape of a needle 30 fastened axially inside the bore 26 by means of a supporting device 31 having passage orifices for the drilling fluid on the periphery of the central needle 30.

Downstream of the needle 30 and the support 31, the central bore of the element 21 of the set of rods has a diameter reduced in relation to the bore 26 and opens, via orifices 33, into the inner bore of the tubular body 23 round the end part of the element 21 of reduced diameter and possessing at its end an orifice in the form of a portion of the sphere constituting the female part of a ball joint for the articulated assembly of the first element 21 and of the second element 22 of the set of rods. The second element 22 possesses, at its end located in the extension of the element 21, a spherical assembly bearing surface constituting the male part of the ball joint for assembling the elements 21 and 22. The assembly ball joint 32 makes it possible to drive the second element 22 in rotation by means of the first element 21, whilst at the same time allowing an angular misalignment of the second element 22 connected to the drilling tool in relation to the first element 21 connected to the section of the set of rods terminating at the surface.

The piston 27 comprises a body 27*b*, in which are machined two groups of ramps 35*a* and 35*b* inclined relative to the axis of the first element 21 of the set of rods.

Each of the groups of ramps 35*a* and 35*b* comprises a plurality of ramps arranged on the periphery of the piston 27 in angular positions uniformly spaced about the axis of the piston 27 coinciding with the axis of the element 21.

Figure 5:
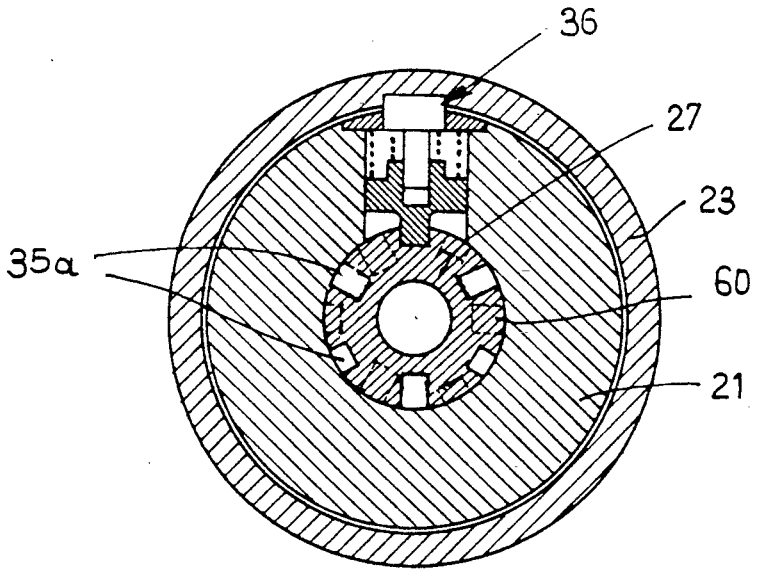
FIG. 5 is a cross-sectional view according to 5—5 of FIG. 2A.
Figure 6:
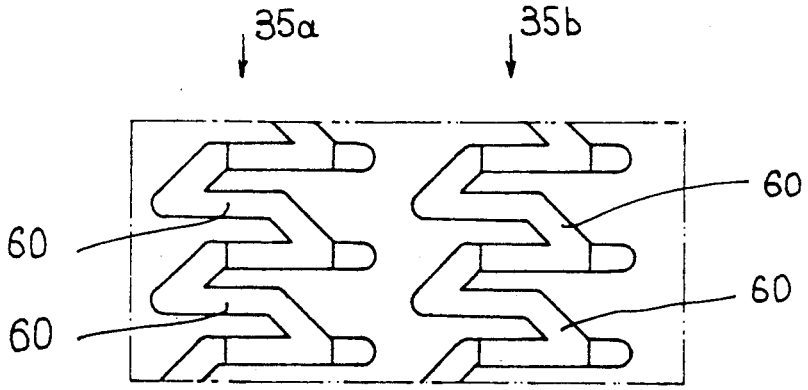
FIG. 6 is a developed view of the actuating ramps of the device.

The various parts of the groups of ramps 35*a* and 35*b* are connected to one another by means of grooves of constant depth machined in the peripheral surface of the piston 27, in such a way that the various parts of the ramps and the grooves of constant depth constitute a continuous track round the peripheral surface of the body 27*b* of the piston 27, as can be seen in FIGS. 5 and 6.

Applied to each of the tracks comprising the group of ramps 35*a* or the group of ramps 35*b* by means of springs are one or more locking assemblies 36 allowing a junction to be made between the element 21 of the set of rods and the tubular body 23, so as to fix the set of rods and tubular body relative to one another in terms of rotation or, on the contrary, to allow the set of rods to rotate within the tubular body as a result of the release of the assembly 36.

Figure 3:
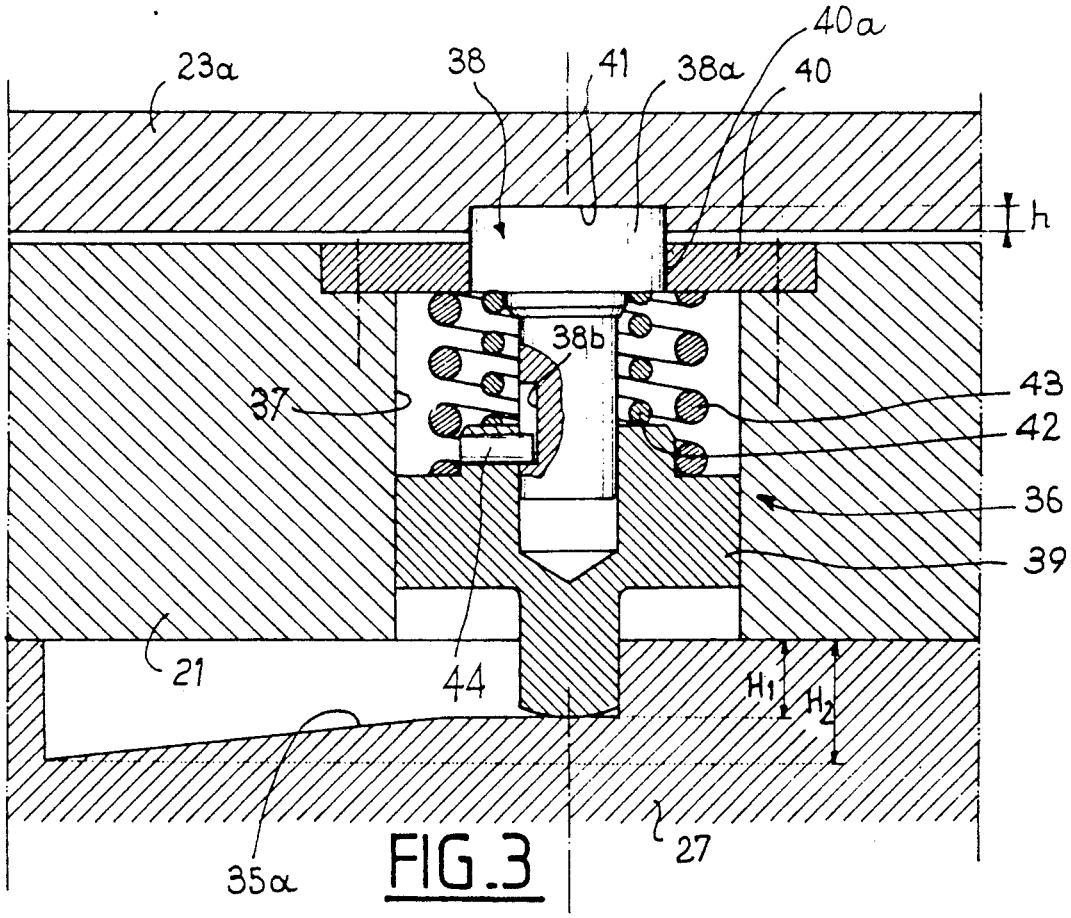
FIG. 3 is a sectional view on a larger scale of the detail 3 of FIG. 2A, showing a junction means between the set of rods and the tubular body of the means for adjusting the azimuth angle.
Figure 4:
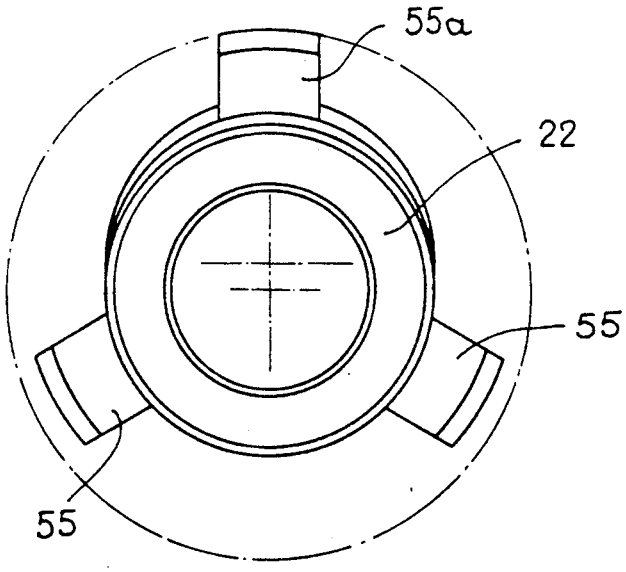
FIG. 4 is an end view according to 4 of FIG. 2B.

It can be seen from FIG. 3 that the assembly 36 is seated in an aperture 37 passing through the wall of the tubular element 21 in a radial direction.

Each of the assemblies 36 comprises a locking finger 38 and an actuating finger 39, the inwardly directed end of the locking finger 38 being engaged in a blind bore made in the axial direction of the actuating finger 39.

The radial aperture 37 of the element 21 has a closing plate 40 arranged at its end opening outwards, the plate 40 possessing a central orifice 40*a*, in which the head 38*a* of the locking finger 38 is engaged.

Interposed between the head 38*a* of the locking finger 38 and the actuating finger 39 is a first restoring spring 42 which tends to push the locking finger 38 outwards.

Interposed between the closing plate 40 and the actuating finger 39 is a second helical restoring spring 43 which tends to push the finger 39 inwards, that is to say in the axial direction of the piston 27 and of the element 21.

A stud or a key 44 is fastened in the bore of the actuating finger 39 so as to project radially inwards, in such a way as to engage in an axial aperture 38*b* made in the lateral surface of the locking finger 38. The stud 44 makes it possible to ensure the return of the locking finger 38 under the effect of the spring 43 by means of the actuating finger 39.

In the active position, as shown in FIG. 3, the head 38*a* of the locking finger 38 engages in an orifice 41 of depth h machined in the inner surface of the part 23*a* of the tubular body 23. In its active position, the locking stud 38 makes the connection between the element 21 of the set of rods and the tubular body 23 in terms of rotation about their common axis.

The finger assemblies 36, such as those shown in FIG. 3, are actuated by the piston 27, the ramps 35*a* and 35*b* of which are capable of coming opposite the interacting end of the actuating finger 39, as can be seen in FIG. 3.

Each of the ramps 35*a* and 35*b* comprises an end part, of which the depth H1 in the radial direction from the outer surface of the piston 27 is at a minimum, and an end part, of which the depth H2 under the outer surface of the piston 27 in the radial direction is at a maximum.

The successive junction parts 60 of the group of ramps 35*a* or 35*b* consist of grooves, the bottom of which is either at the depth H1 or at the depth H2.

When drilling fluid circulates in the bore of the piston 27, this drilling fluid experiences a loss of head in the region of the contraction 27*a* confronting the frustoconical needle 30. When the flow of drilling fluid increases, the loss of head on either side of the piston 27 increases until the force generated on the piston by this loss of head is capable of displacing the piston 27 in the axial direction counter to the restoring force of the spring 28. The corresponding flow of the drilling fluid is called the actuating flow.

It should be noted that when the piston 27 is displaced under the effect of the force generated by the loss of head in the direction of flow of the drilling fluid (arrow 29), the loss of head increases continuously as a result of interaction of the contraction 27*a* and the frustoconical needle 30.

At the end of the displacement of the piston 27, the end part of the actuating finger 39 having reached one end of the ramp, the loss of head is at a maximum, with the result that a pressure measurement of the drilling fluid carried out at the surface makes it possible to check the position of the piston 27 and the execution of a displacement step of the control means.

The flow of drilling fluid is reduced or cancelled in such a way that the spring 28 can return the piston to its initial position, the end of the actuating finger 39 taking its place in a groove of constant depth so as to return to a position of equilibrium either at the depth H1 or at the depth H2.

In their position of equilibrium, therefore, the ends of the actuating fingers 39 interacting with the ramps 35*a* and 35*b* are liable to be at a depth H1 or at a depth H2 below the surface of the piston 27, the spring 43 ensuring that the actuating fingers are returned against the ramps.

When the finger 39 is at the depth H1, this finger exerts on the locking finger 38, by means of the spring 42, an outward thrust which results in a displacement of the finger 38 over a length when the head 38*a* of the finger 38 comes into coincidence with an orifice 41 of the tubular body 23.

When the finger 39 is at a depth H2, this finger 39 ensures the inward return of the locking finger 38 by means of the stud 44 over a height h, with the result that the element 21 is released and the set of rods is capable of rotating within the tubular body 23.

The first part 23*a* of the tubular body 23 is mounted rotatably on the first element 21 of the set of rods by means of radial bearings 46*a*, 46*b* and 47 and an axial bearing 48, in such a way that the first part 23*a* of the tubular body 23 is coaxial with the first element 21, the axis of which itself coincides with the axis of the part of the set of rods comprising its first end terminating at the surface.

Furthermore, gaskets 49 and 51 are interposed between the element 21 and the tubular body 23, in order to prevent the drilling fluid from passing between these two components.

The second part 23*b* of the tubular body 23 is mounted on the first part 23*a* by means of a frustoconical assembly bearing surface 53, the axis of which forms a particular angle (of the order of a few degrees) with the axis of the element 21.

The second part 23*b* of the tubular body 23 engaged on the first part 23*a* by means of the bearing surface 53 can be rotated about the axis of this bearing surface and put into such an orientation that the axis of the bore of the second part 23*b* of the tubular body 23 forms a particular angle $\alpha$ with the axis of the bore of the first part 23*a* of the tubular body 23 coinciding with the axis of the element 21.

The angle $\alpha$ can be adjusted to a value of between 0 and double the angle of misalignment of the frustoconical bearing surface 53 in relation to the axis of the bore of the part 23*a* of the tubular body.

Blocking screws 54 make it possible to carry out the fastening and rotational blocking of the second part 23*b* of the tubular body 23 on the first part 23*a*.

This adjustment of the angle $\alpha$ is carried out at the surface, before a drilling operation is started.

The angle $\alpha$ is selected as a function of the desirable amount of adjustment of the azimuth angle of the direction of the drilling path.

The tubular body 23 is a bent tubular element comprising two successive sections of which the axes form an angle $\alpha$.

The second part 23*b* of the tubular body carries three radially projecting blades 55 which are located in angular positions of 120° on its outer surface and one (55*a*) of which is on the outer side of the bend of the tubular body 23.

The second element 22 of the set of drill rods has an internally threaded frustoconical orifice 22*a* making it possible to mount the drilling tool or an adapter piece of this drilling tool on the end of the element 22 opposite its end mounted in an articulated manner on the end of the element 21.

The element 22 has an inner bore communicating via orifices 56 with the inner bore of the tubular body 23.

The element 22 is mounted rotatably within the bore of the second part 23*b* of the tubular body 23 by means of a radial bearing 57 and an axial bearing 58. A gasket 59 is interposed between the inner surface of the bore of the tubular body and the outer surface of the second element of the set of rods. The axis of the second element 22 of the set of rods arranged coaxially in the second section of the tubular body 23 therefore forms an angle $\alpha$ with the axis of the first element 21 of the set of rods arranged coaxially relative to the first section 23*a* of the bent tubular body 23.

The functioning of the drilling device according to the invention in a first operating mode without an adjustment of the azimuth angle of the drilling path and de with an adjustment of the azimuth angle of the drilling path and the changeover from one operating mode to the other will now be described.

The drilling device according to the invention has the general structure illustrated in FIG. 1 and means for controlling the device for adjusting the azimuth angle, such as those shown in FIGS. 2A and 2B.

As mentioned above, the tubular body 23 is adjusted in such a way that the angle $\alpha$ of misalignment of its two sections is set as a function of the desirable adjustment of the azimuth angle.

In a first operating mode, the drilling device can function without an adjustment of the azimuth angle, the set of rods and the tubular body being fixed relative to one another in terms of rotation by means of junction devices, such as the devices 36 shown in FIG. 2A.

The set of rods, the drilling tool and the tubular body 23 rotate together about the axis of the upper part of the set of rods coinciding with the axis of the first element of the set of rods engaged in the first section of the tubular body. An axial force is transmitted by the set of rods, in such a way as to carry out the drilling in the axial direction of the first part of the set of rods.

During functioning in the first mode, the presence of the bent tubular body 23 functioning in the manner of a rigid connection results simply in a widening of the drill hole of small extent, the angle $\alpha$ having a low value.

Figure 8:
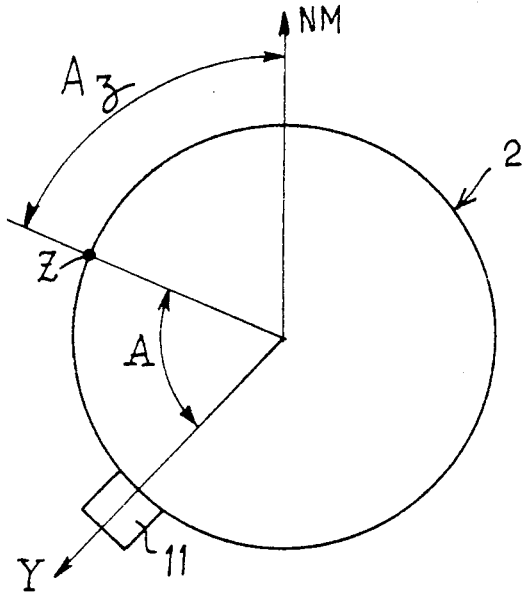
FIG. 8 is a diagrammatic view showing the principle of the adjustment of the azimuth angle of the path of a drilling tool.

As can be seen in FIG. 8 which illustrates highly diagrammatically the set of rods 2 engaged in a tubular body having a bearing blade 11, a reference Z makes it possible to determine by telemetering the angular position of the set of rods and of the blade 11 of the tubular body about the axis of the set of rods and in relation to the direction of the magnetic north (MN).

The azimuth position of the reference Z (defined by the angle Az) can be monitored from the surface by telemetering, so as to determine the adjustments or corrections to be made to the azimuth direction of the drilling path.

The angle A between the direction of the reference Z and the radial direction Y of the blade 11 is fixed at a specific value in the first operating mode, the engagement of the locking fingers in specific orifices of the tubular body defining an angular indexing of the tubular body in relation to the set of rods.

As mentioned above, the adjustment of the azimuth angle of the drilling path (second operating mode of the device) is obtained by adjusting the angular position of the bearing blade 11 in the drill hole and by releasing the set of drill rods, in such a way as to allow it to be set in rotation within the tubular body, after the blade 11 has been brought to bear against the wall of the drill hole in a specific position under the effect of the lateral forces generated and arising as a result of the axial force on the set of rods.

The changeover from the first operating mode without an adjustment of the azimuth angle to the second operating mode with an adjustment of the azimuth angle is therefore carried out by releasing the means locking the tubular body on the set of rods and by orienting the tubular body in such a way that the bearing blade is in the desired position, as will be described below.

Since the drilling device functions in the first mode without an adjustment of azimuth, to change over to the second operating mode with an adjustment of the azimuth angle, in the first place the axial force on the tool exerted by means of the set of rods is relaxed, without the tool being detached from the bottom of the drill hole, and the rotation of the set of rods ensuring the drilling is stopped.

The angular position of the blade 11 (or 55*a*) in relation to the magnetic north is adjusted, so as to make the adjustment of the azimuth angle in the desired direction, by rotating the set of rods through a specific angle from the surface. This rotation of the set of rods brings about the same rotation of the tubular body fixed to the first element of the set of rods and the angular positioning of the bearing blade.

Axial force is exerted once again on the set of rods so as to generate a reaction force $FR_1$ (see FIG. 1) in the region of the bearing blade, thereby fixing the angular position of the bearing blade and of the tubular body 10.

Where a control device, as shown in FIGS. 2A and 2B, using the flow of the drilling fluid is concerned, the flow is increased in such a way as to cause it to change to the value for activating the control means.

Figure 9:
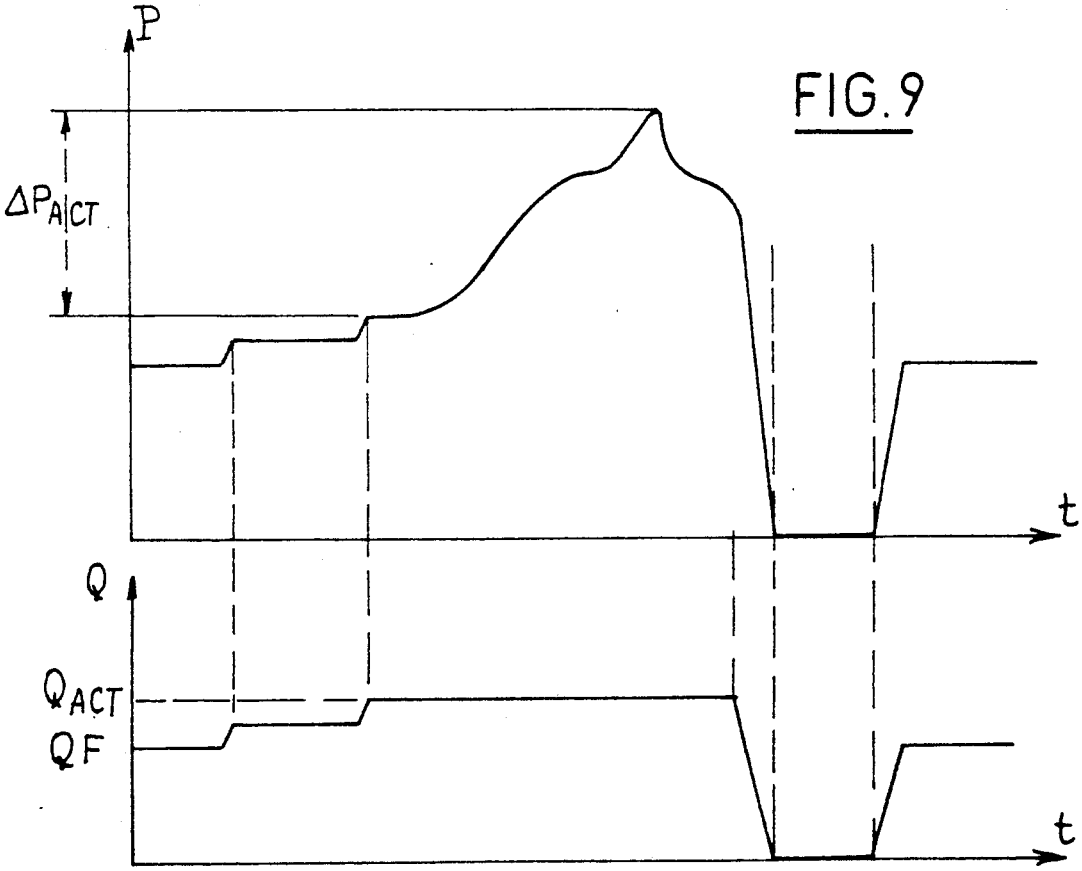
FIG. 9 is a representation of the variations of the pressure and flow rate of the drilling fluid in the set of rods as a function of time during an operation for the actuation of adjustment means according to the invention.

The lower part of FIG. 9 shows the variations in the flow over time. The flow Q changes from the value during drilling QF to the value for activating the control means QACT with a plateau at an intermediate value.

When the flow reaches the value QACT, the piston 27 is displaced in the direction of circulation of the fluid, in such a way that the loss of head increases at the outlet of the piston 27 as a result of the interaction of the contraction 27*a* and the needle 30 of frustoconical shape.

As can be seen in FIG. 9, during the displacement phase of the piston the flow is maintained at the value QACT (lower part of FIG. 9), but the loss of head $\delta P$ increases from the value 0 to the maximum value $\delta PACT$ which is reached when the piston has concluded its displacement in the direction of circulation of the fluid (upper part of FIG. 9). The curve of variation of the pressure of the drilling fluid as a function of time reaches a maximum at the moment when the contact part of the actuating fingers reaches the end of the ramp having the lowest level (level H2 in FIG. 3).

Recording the pressure makes it possible to follow the displacement of the piston and the position of the actuating fingers from the surface.

When the actuating fingers are in contact with the ramp at a depth H2, the heads 38*a* of the locking fingers are returned to the position $h=0$ by the studs 44 of the actuating fingers The set of rods is thus freely rotatable relative to the tubular body.

The circulation of drilling fluid in the set of rods is interrupted, so that the piston 27 is returned by the spring 28 in the opposite direction to the circulation of the drilling fluid. The ends of the actuating fingers are displaced into contact with a groove 60 of constant depth H2 which joins two successive ramps. The actuating fingers pass from the ramp to the groove of constant depth as a result of a rotation of the piston 27 about its axis, when the actuating fingers come into contact at the end of the ramps with curved junction parts between the ramps 35 and the grooves 60 of constant depth.

The piston is then in its position of equilibrium and the fingers 38 are released.

The flow of drilling fluid is restored to the value QF, thus not causing any displacement of the piston 27, the flow QF being lower than the actuating flow QACT.

The pressure of the drilling fluid, after changing from its maximum value to a zero value, rises again to an intermediate value corresponding to the substantially constant value of the pressure during drilling.

The set of rods is put into rotation again in order to recommence drilling.

The set of rods is freely rotatable in the tubular body 23, with the result that the first element 21 of the set of rods drives a second element 22 in rotation, this second element fixed to the drilling tool having an axis forming an angle $\alpha$ with the first element arranged in the first section of the tubular body 23.

A correction of the azimuth angle of the direction of the drilling path is obtained in this way, this azimuth correction being made in the desired direction by means of the angular position of the blade 55 bearing on the edge of the hole and of an extent determined by the value of the angle $\alpha$.

The set of rods arranged inside the bent tubular body has a misalignment identical to the misalignment of the two sections of the tubular body; during drilling, the advance of the drilling tool brings about an advance of the set of rods and of the tubular body fixed in terms of translational movement to this set of rods, the bearing blade 55*a* being driven in frictional contact with the wall of the drill hole.

To change from the second operating mode to the first, that is to say to change from an operating mode with an adjustment of the azimuth angle of the drilling path to an operating mode without an adjustment of the azimuth angle, the axial force exerted on the drilling tool by means of a set of rods is released and the tool is detached from the bottom of the hole.

The flow of drilling fluid is increased to the activation value QACT, so as to cause the end of the actuating fingers in contact with the ramps of variable depth to change from the level H2 to the level H1 where the locking fingers 38 are pushed outwards by the restoring springs 42 and 43.

The flow of drilling fluid is cancelled in order to return the piston to its position of equilibrium.

The set of rods is rotated within the tubular body in order to obtain the engagement of the locking fingers 38, the heads 38*a* of the fingers 38 pushed by the springs 43 engaging in the corresponding orifices 41 when the heads and the orifices have come into coincidence with one another.

Drilling can then resume. the mutual fixing in terms of rotation of the elements 21 and 22 of the drill rod and of the tubular body 23 cancelling the effect of the misalignment $\alpha$ introduced by the bent tubular body 23.

Figure 7:
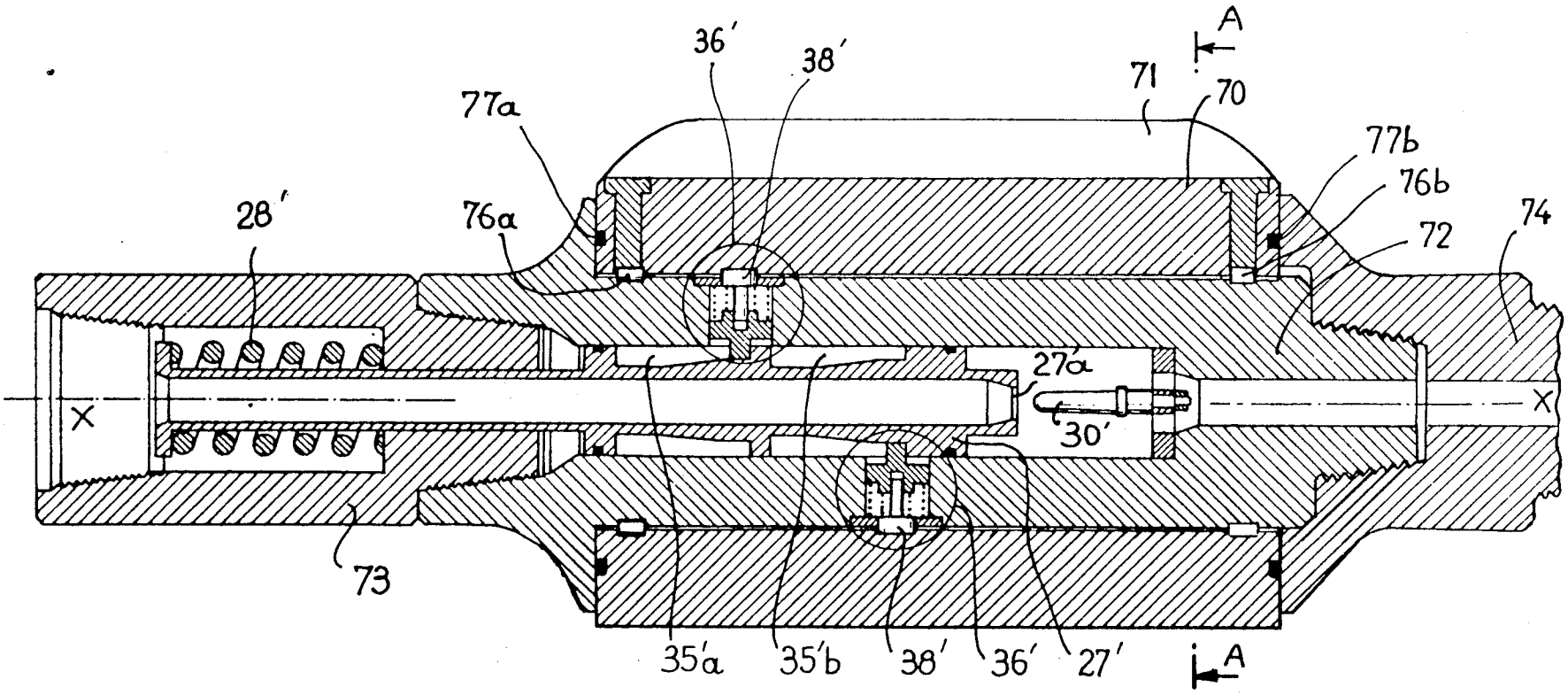
FIG. 7 is a view in axial section of means for adjusting the azimuth angle of the path of the drilling tool according to a second embodiment.

FIGS. 7, 7A and 7B illustrate a second embodiment of the means for adjusting the azimuth angle of the path of a drilling tool, which functions on the general principle explained above with reference to FIG. 1 and by the use of remote-control means similar to the means described in relation to FIGS. 2A and 2B. Likewise, the use of these means for changing from an operating mode without an adjustment of the azimuth angle to an operating mode with an adjustment of the azimuth angle, or vice versa, is substantially similar to the process just described with regard to the embodiment of FIGS. 2A and 2B.

Like elements in FIGS. 2A and 2B on the one hand and 7 on the other hand bear the same references, but with the exponent ' (prime) for the elements shown in FIG. 7. These elements constitute the junction device between the set of rods and the tubular body and its control means which are produced in a similar way in both the first and the second embodiment.

In the second embodiment illustrated in FIG. 7, the tubular body 70 mounted rotatably on the set of rods and fixed in terms of translational movement to this set of rods is produced in the form of a bearing-blade stabiliser of the type used for making corrections of paths on sets of rods by means of the deformation of the set of rods under the effect of lateral forces exerted on the edge of the drill hole by the stabiliser.

However, in contrast to known stabilisers used for making path corrections, the tubular body 70 is mounted rotatably on the set of rods and the set of rods can be fixed in terms of rotation to the tubular body 70 or, on the contrary, made freely rotatable in the tubular body 70 by remote-control means using the drilling fluid which are of the type described above.

The tubular body 70 is mounted rotatably on an intermediate piece 72 of the set of rods, connected at one of its ends to a first screwed connection 73, making it possible to fasten the piece 72 to that part of the set of rods comprising its first end terminating at the surface, and at its other end to a second screwed connection 74, making it possible to connect the intermediate piece 72 to that part of the set of rod carrying the drilling tool.

The tubular body 70 is mounted rotatably on the intermediate piece 72 by means of roller bearings 76*a* and 76*b* and is held fixed in terms of translational movement to the set of rods between a shoulder of the piece 72 and a shoulder of a second connection 74.

Thrust ball bearings and gaskets 77*a* and 77*b* are interposed between the body 70 and the shoulders of the set of rods.

As can be seen in FIG. 7A, the tubular body 70 comprises a bearing blade 71 and two guide blades 78*a* and 78*b* projecting radially outwards. The outer edges of the guide blades 78*a* and 78*b* are located on a circular contour 79 which is centred on the axis of the set of rods and the diameter of which corresponds to the diameter D of the drill hole. The outer edge of the bearing blade 71 projects relative to the contour 79 by a radial length e.

FIG. 7B illustrates an alternative embodiment 70' of the tubular body 70 which comprises two guide blades 78'*a* and 78'*b* and a bearing blade 71', the outer edges of which are located on a circle 79', the radius of which has a length D/2−h slightly smaller than the radius of the drill hole. The circle 79'is centred on a point located at a distance k from the axis of the set of rods and of the intermediate piece 72. In its position shown in FIG. 7B, the bearing blade 71' is in its position of maximum offset.

The means for adjusting the azimuth angle, shown in FIGS. 7, 7A and 7B, can be controlled in a similar way to the adjustment means illustrated in FIGS. 2A, 2B and 3 to 6 by actuable junction devices 36' comprising locking fingers 38' actuated by the ramps 35'*a* and 35'*b* of a piston 27' and by restoring springs.

These control means were described with regard to the first embodiment.

The piston 27' is displaced in one direction by means of a force generated as a result of the loss of head in the region of the orifice 27'*a* interacting with the frustoconical needle 30' and in the other direction by the restoring spring 28'.

Thus, as described previously, the rotational locking or release of the set of rods and of the tubular piece 70 in the region of the intermediate piece 72 can be remotely controlled. When the pieces 70 and 72 are fixed relative to one another in terms of rotation, the assembly consisting of the set of rods, of the tubular piece 70 and of the drilling tool rotates about the axis of the set of rods. Drilling is carried out without an adjustment of the azimuth angle, the presence of the offset bearing blade resulting in a slight widening of the drill hole.

To make an adjustment of the azimuth angle, the blade 71 (or 71') is brought to bear on the edge of the drill hole in a specific angular position, as described above.

The fingers 38' are subsequently released by remote control, in order to allow the set of rods to rotate within the tubular piece 70 or 70'.

The azimuth adjustment is carried out by the angular misalignment of the lower part of the set of rods carrying the tool, such as the part 15 shown in FIG. 1, in relation to the upper part 16 comprising the first end of the set of rods under the effect of the radial forces generated during drilling and exerted on the part 15 of the set of rods. The azimuth adjustment therefore depends on the angular position of the bearing blade and its offset and on the geometrical and mechanical characteristics of the part 15 of the set of rods.

The device according to the invention thus makes it possible to carry out a remote-controlled adjustment of the azimuth angle of the path of a drilling tool in rotary drilling.

Should the drilling device function with an adjustment of the azimuth angle of the path of the drilling tool, it is possible to return by remote control to an operating mode without an adjustment of the azimuth angle of the path.

The change from one operating mode to the other is made quickly and reliably, and the control means can be monitored from the surface, for example by measuring the pressure of the drilling fluid.

The invention therefore makes it possible to adjust the azimuth angle of the path of a drilling tool, without using a bottom motor.

The invention is not limited to the embodiment described.

Thus, the control means for executing the locking or release of the tubular body on the set of rods can be produced in a form different from that described. These control means using the pressure or flow of the drilling fluid are well known in the art of directional drilling at great depth.

The junction means between the drill rod and the tubular body can be produced in a form different from that described using fingers arranged in radial directions.

The tubular body can be produced in a form different from those described, and this tubular body can be made in one or more pieces, with or without the possibility of adjustment of the angle of misalignment or offset of the bearing blade.

Finally, the invention is used in general terms on any rotary device.

We claim:

1. Rotary drilling device comprising remote-controlled means for adjusting the azimuth angle of the path of a drilling tool (3) and including a set of rods (2) having a first end connected to a means (5) for setting the set of rods in rotation about an axis of the set of rods and for exerting an axially directed force on the set of rods and a means (6) for supplying drilling fluid to the set of rods, ensuring an axial circulation of the fluid as far as the drilling tool (3) connected to a second end of the set of rods, characterised in that the means for adjusting the azimuth angle of the path of the drilling tool (3) comprises:

a tubular body (10, 23, 70, 70') comprising at least one radially outwardly-projecting bearing blade (11, 55*a*, 71, 71'), mounted rotatably on the set of rods (2) and fixed in terms of translational movement to the set of rods, wherein the tubular body is so located on the set of rods as to divide them into two parts (15, 16) one part 15 being located between the first end of the set of rods and the tubular body and the other part (16) being located between the tubular body and the second end of the set of rods; and, an anti-rotation locking means (36, 36') located between the set of rods (2) and the tubular body (10, 23, 70), carried by the set of rods (2), movable between an active position and an inactive position and remotely actuable by a control means (27, 30, 27', 30') activated by the drilling fluid circulating in the set of rods (2), making it possible, in its active position to drive the tubular body (10, 23, 70) in rotation by the set of rods (2) and, in its inactive position, to rotate the set of rods (2) in relation to the tubular body, the adjustment of the azimuth angle of the path of the drilling tool (3) thus being ensured by bringing the at least one blade (11, 55*a*, 71, 71') of the tubular body to bear on the wall of the drill hole (4) in a specific position.

2. Drilling device according to claim 1, characterised in that the set of rods (2) comprises two elements (21, 22) arranged in succession, connected to one another in an articulated manner at one of their ends and fixed at their other ends, wherein said first element (21) other end is fixed to a part of the set of rods comprising the first end and, wherein said second element (22) other end is fixed to the drilling tool (3), and wherein the tubular body (23) comprises two successive sections (23*a*, 23*b*), the axes of which form an angle $\alpha$ with one another, the first element (21) of the set of rods being mounted rotatably about its axis in a first section (23*a*) of the tubular body (23), and the second element (22) being mounted rotatably about its axis in the second section (23*b*) of the bent tubular body (23), the adjustment of the azimuth angle of the path of the drilling tool (3) being ensured by the immobilisation in terms of rotation of the bent tubular body (23), the blade (55*a*) of which is brought to bear on the wall of the drill hole in a specific position and as a result of the angular misalignment of the two elements (21, 22) of the set of rods within the bent tubular body (23).

3. Drilling device according to claim 2, characterised in that the tubular body (23) comprises two parts (23*a*, 23*b*) of tubular shape, one of these parts (23*a*) having a bearing surface (53), the axis of rotational symmetry of which is arranged angularly relative to the axis of the part (23*a*), the element (23*b*) having a corresponding bearing surface and being rotatable about the axis of the bearing surface, so as to adjust the angle of misalignment $\alpha$ between the tubular parts (23*a*, 23*b*) constituting the two successive sections of the tubular body (23) to a specific value.

4. Drilling device according to claim 1, wherein the tubular body (70, 70') comprises a stabiliser having a bearing blade (71, 71') which is coaxial with the axis of the set of rods (2) initially, and in which an angular misalignment of the two parts (15, 16) of the set of rods can be brought about by the application of a downward force to the set of rods.

5. Drilling device according to claim 1 wherein said anti-rotation locking means (36, 36') between the set of rods (2) and the tubular body (23, 70, 70') comprises at least one locking finger (38, 38') arranged in a radial direction and returned outwards by a first spring (42), so as to engage in an orifice (41) made in an inner surface of the tubular body (23, 70, 70').

6. Drilling device according to claim 5, wherein said control means for said anti-rotation locking means (36, 36') comprises an actuating finger (39) actuating the locking finger (38, 38'), ensuring that the locking finger (38, 38') is actuated by means of the first spring (42) interposed between the actuating finger (39) and the locking finger (38, 38') and of a stud (44) engaged in an orifice (38*b*) of the actuating finger 38, a second spring (43) ensuring that the actuating finger (39) is returned inwards in the radial direction, so as to put one end of the actuating finger (39) in contact with an actuating surface (35*a*, 35*b*) of a control means (27, 27') of the actuating finger (39), for its displacement in the radial direction as a result of the axial displacement of a control means (27, 27') driven by the drilling fluid circulating in the set of rods or by a return means (28, 28').

7. Drilling device according to claim 6, wherein the control means (27, 27') comprises a tubular piston mounted slidably and rotatably in the bore of a set of rods and having at one of its ends a profiled part (27*a*,27'*a*) intended for interacting with a profiled part of corresponding shape (30, 30'), in order to increase the loss of head in the circulation of the drilling fluid on either side of the piston (27, 27') during displacement of the piston int he direction of circulation of the drilling fluid, the piston possessing, on its outer surface, actuating ramps (35*a*, 35*b*, 35'*a*, 35'*b*) inclined relative to the axis common to the piston (27, 27') and to the set of rods and connected to one another by grooves of constant depth, the bottom of which is parallel to the axis of the piston (27, 27'), to form a continuous track which is arranged around the piston (27, 27') and on which the end of the actuating finger (39) is brought to bear by the second spring (43) interposed between bearing surfaces of the set of rods and of the actuating finger (39).

8. Drilling device according to either one of claims 2 and 3, characterised in that the first element (21) and the second element (22) of the set of rods possess, in their end part making their articulated junction, orifices (33, 56) putting their central bore in communication with the inner volume of the tubular body (23), so as to ensure a circulation of drilling fluid at the periphery of the end parts making the articulated junction of the elements (21, 22) of the set of rods, in order to obtain a continuous circulation of drilling fluid as far as the drilling tool (3).

9. A rotary drilling device comprising:

a set of rods having a drilling tool at one end;

a means for rotating the set of rods and for exertion an axially directed force on the set of rods; and, a means for adjusting the azimuth angle of the path of the drilling tool, said means for adjusting comprising:

an intermediate piece fixedly secured to the set of rods and dividing the set of rods into an upper part, above said intermediate piece, and a lower part, below said intermediate piece and extending to said drilling tool;

a tubular body rotatably mounted on said intermediate piece and fixed in terms of translation in relation to said intermediate piece, said tubular body comprising at least one radially outwardly projecting bearing blade, an anti-rotation locking means disposed between said intermediate piece and said tubular body, said locking means being carried by said intermediate piece and being movable between an active position in which said locking means permits said tubular body to rotate together with the set of rods and an inactive position in which said tubular body does not rotate together with the set of rods, and a remote control means for activating and deactivating said anti-rotation locking means.

10. The device of claim 9 wherein said tubular body comprises a stabilizer and said at least one bearing blade is initially coaxial with a longitudinal axis of the set of rods, and wherein an angular misalignment of said upper and lower part of the set of rods can be brought about by the application of a downward force on the set of rods.

11. The device of claim 9 wherein said anti-location locking means comprises:

a locking finger extending radially outwardly in a radial aperture in said intermediate piece and selectively contacting said tubular body; and a first biasing means for urging said locking finger radially outwardly.

12. The device of claim 11 wherein said anti-location locking means further comprises:

a actuating finger extending radially inwardly in said radial aperture in said intermediate piece and operatively secured to said locking finger; and a second biasing means for urging said actuating finger radially inwardly.

13. The device of claim 9 wherein said remote control means comprises:

a piston mounted for reciprocation along a defined stroke from a first end position to a second end position in a central bore of said intermediate piece, said piston having a tubular shape and having a central bore which comprises a profiled throttling portion the minimum internal diameter of which is smaller than the internal diameter of the central bore of the piston;

a needle fixedly secured to said intermediate piece in said central bore thereof, wherein said piston is movable along said defined stroke from said first end position to said second end position at which said piston encloses at least a portion of said needle and a gap exists therebetween; and a spring for biasing said piston towards said first end position.

14. The device of claim 13 wherein said piston remains at said first end position at a first flow rate of a drilling fluid through said central bore of said intermediate piece and wherein said piston moves towards said second end position under a second, increased, flow rate of the drilling fluid.

15. The device of claim 14 wherein said anti-rotation locking means comprises:

a locking finger extending radially outwardly in a radial aperture in said intermediate piece and selectively contacting said tubular body;

a first biasing means for urging said locking finger radially outwardly;

a actuating finger extending radially inwardly in said radial aperture in said intermediate piece and operatively secured to said locking finger; and, a second biasing means for urging said actuating finger radially inwardly.

16. The device of claim 15 further comprising:

a groove of varying depth located on an outer periphery of said piston, said actuating finger extending into said groove; and, an orifice located on an inner periphery of said tubular body, an outer end of said locking finger selectively extending into said orifice.

* * * * *